United States Patent [19]

Mueller

[11] Patent Number: 4,964,539

[45] Date of Patent: Oct. 23, 1990

[54] MULTIPLE CHAMBER DISPENSING CONTAINER AND CLOSURE SYSTEM

[75] Inventor: Bruce M. Mueller, Crystal Lake, Ill.

[73] Assignee: Seaquist Closures, Crystal Lake, Ill.

[21] Appl. No.: 334,071

[22] Filed: Apr. 6, 1989

[51] Int. Cl.[5] ..... B65D 35/22

[52] U.S. Cl. ..... 222/94; 222/132; 222/145; 222/563; 215/344; 220/355

[58] Field of Search ..... 222/94, 107, 129, 132, 222/145, 556, 563; 215/343-345; 220/355

[56] References Cited

U.S. PATENT DOCUMENTS

| | | | |
|---|---|---|---|
| 1,699,532 | 1/1929 | Hopkins . | |
| 2,354,004 | 7/1944 | Fess | 222/563 |
| 2,921,716 | 1/1960 | Schiller | 222/563 |
| 2,932,436 | 4/1960 | Dobbins | 222/563 |
| 3,105,615 | 10/1963 | Koga . | |
| 3,175,731 | 3/1965 | Ellman . | |
| 3,197,071 | 7/1965 | Kuster . | |
| 3,227,332 | 1/1966 | Gowdy et al. | 222/563 |
| 3,335,912 | 8/1967 | Reeves, Jr. . | |
| 3,351,242 | 11/1967 | Lodding et al. . | |
| 3,506,157 | 4/1970 | Dukess . | |
| 3,729,553 | 4/1973 | Gold et al. | 222/94 |
| 3,788,520 | 1/1974 | Dukess . | |
| 4,089,437 | 5/1978 | Chutter et al. | 222/94 |
| 4,099,651 | 7/1978 | von Winckelmann . | |
| 4,106,672 | 8/1978 | Tecco et al. . | |
| 4,528,180 | 7/1985 | Schaeffer . | |
| 4,687,663 | 8/1987 | Schaeffer . | |
| 4,778,071 | 10/1988 | Fillmore | 222/556 |
| 4,801,054 | 1/1989 | Nycz | 222/556 |
| 4,823,967 | 4/1989 | Thompson | 215/344 |
| 4,844,273 | 7/1989 | Hawkins | 215/343 |
| 4,884,703 | 12/1989 | O'Meara | 215/6 |

FOREIGN PATENT DOCUMENTS

| | | | |
|---|---|---|---|
| 3514134 | 10/1986 | Fed. Rep. of Germany | 222/94 |
| 731937 | 6/1932 | France | 222/94 |
| 281613 | 1/1931 | Italy | 222/94 |
| 521688 | 7/1938 | United Kingdom | 222/107 |

*Primary Examiner*—H. Grant Skaggs
*Assistant Examiner*—Steven M. Reiss
*Attorney, Agent, or Firm*—Dressler, Goldsmith, Shore, Sutker & Milnamow

[57] ABSTRACT

A package is provided for dispensing at least two substances simultaneously in an adjacent relationship. The package includes a container having a plurality of separated storage compartments. The container has an outlet end with a peripheral outlet wall and at least one interior divider wall cooperating to define a plurality of discharge passages each communicating with a respective one of the compartments. The outlet wall has interior peripheral sealing surfaces that each define a portion of the inner periphery of a respective one of the discharge passages. Each divider wall has generally oppositely facing sealing surfaces that each define a portion of the inner periphery of a respective one of the discharge passages. A cover is provided for securement to the container over the outlet end. The cover includes at least a plurality of downwardly projecting interior sealing members for each projecting into a respective one of the discharge passages to seal against each divider wall sealing surface and interior peripheral sealing surface that defines the inner periphery of the respective one discharge passage.

20 Claims, 1 Drawing Sheet

MULTIPLE CHAMBER DISPENSING CONTAINER AND CLOSURE SYSTEM

TECHNICAL FIELD

This invention relates to a package, such as a container and cover, from which at least two substances can be dispensed substantially simultaneously in an adjacent relationship.

BACKGROUND OF THE INVENTION AND TECHNICAL PROBLEMS POSED BY THE PRIOR ART

Dispensing packages, containers, receptacles, and the like have been proposed for dispensing two or more different substances or materials substantially simultaneously. For example, with conventional two-component epoxy adhesives, it is necessary to keep both components separated until used. However, it is desirable to be able to dispense both components simultaneously from the same receptacle in proportionally established amounts so that they can be subsequently used.

With some types of materials, it is important to seal the supply of materials within the receptacle when the materials are not being dispensed. For example, with some materials it may be necessary to avoid prolonged exposure to air, and with other materials it may be necessary to store the materials in the receptacle in a sanitary manner that prevents the ingress of contaminants.

Thus, it would be desirable to provide an improved package of the above-described type which would have an improved sealing capability.

Further, it would be beneficial if such an improved package could be provided with an easily operated cover or closure mechanism that could be mounted to, or otherwise integrated with, the container in which the substances are stored.

Additionally, it would be advantageous if the design of such an improved package would permit relatively easy fabrication from relatively low cost materials.

SUMMARY OF THE INVENTION

A package is provided for dispensing at least two substances simultaneously in an adjacent relationship. The package includes a container having a plurality of separated storage chambers or compartments. The container has an outlet end with a peripheral outlet wall and at least one interior divider wall cooperating to define a plurality of discharge passages which each communicate with a respective one of the compartments.

The container outlet wall has interior peripheral sealing surfaces that each define a portion of the inner periphery of a respective one of the discharge passages. Each divider wall has generally oppositely facing sealing surfaces that each define a portion of the inner periphery of a respective one of the discharge passages.

The package also includes a cover for securement to the container over the outlet end. The cover includes at least a plurality of downwardly projecting interior seal members for each projecting into a respective one of the discharge passages to seal against the sealing surfaces of the divider wall and outlet wall that together define the inner periphery of the respective one discharge passage.

Numerous other advantages and features of the present invention will become readily apparent from the following detailed description of the invention, from the claims, and from the accompanying drawings.

BRIEF DESCRIPTION OF THE DRAWINGS

In the accompanying drawings forming a part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the use of the invention. The invention is not intended to be limited to the embodiment so described, and the scope of the invention will be pointed out in the appended claims.

For ease of description, the article of this invention is described in upright position, and terms such as upper, lower, horizontal, etc. are used with reference to this position. It will be understood, however, that the article of this invention may be manufactured, stored, transported, used, and sold in an orientation other than the position described.

Figure 1:
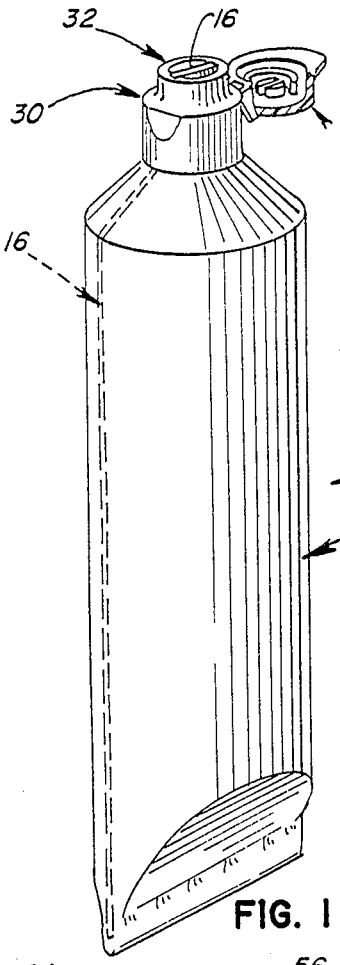
FIG. 1 is a perspective view of a first embodiment of the package of the present invention shown with the cover in the full open position.

A first embodiment of a package in accordance with the teachings of the present invention is designated generally in FIG. 1 by the reference numeral 10. The package 10 includes a container 12. The container 12 is preferably of the type that is easily squeezable, compressible, and/or collapsible.

The container 12 is preferably fabricated from a suitable material that permits the container to be at least temporarily squeezed or compressed. For example, the container 12 may have the form of a tube as illustrated and may be readily extruded from an appropriate synthetic plastic material, such as polyvinyl or polyethylene. On the other hand, the container 12 may be fabricated from other materials, such as thin metal, for example, aluminum, tin, lead, or the like. Container 12 could also be a blow-molded container.

The container 12 is divided into separated storage compartments by a divider wall 16 (FIGS. 1, 3, 5, and 6). Depending upon the construction of the container 12, the divider wall 16 may be integrally formed as a unitary part of the container 12. Alternatively, the divider wall 16 may be a separately formed, plate-like member appropriately retained in the container 12.

In the embodiment illustrated, the container 12 comprises two identical halves which are appropriately joined together in conjunction with the divider wall 16. In particular, when the container 12 and divider wall 16 are fabricated from a thermoplastic material, heat sealing may be used to join the two halves of the container 12 together with the divider wall 16 along the peripheral margins of the divider wall 16. To this end, each half of the container 12 can be provided with an inner recess 20 set back from the mating plane. The peripheral edges of the divider wall 16 are held in the recesses 20 of each half of the container 12, and this construction is permanently maintained by a suitable thermal fusion bond or adhesive bond.

The bottom of the container 12 may have any suitable configuration. In the embodiment illustrated in FIG. 1, the bottom of the container 12 is crimped or squeezed together with the walls of the container 12 being adhesively or thermally bonded together and to the internal divider wall 16. The bottom margin of the divider wall 16 is received in appropriate recesses at the bottoms of the container walls in a manner analogous to the use of the recesses 20 illustrated in FIG. 3 for accommodating the peripheral side margins of the divider wall 16.

Figure 2:
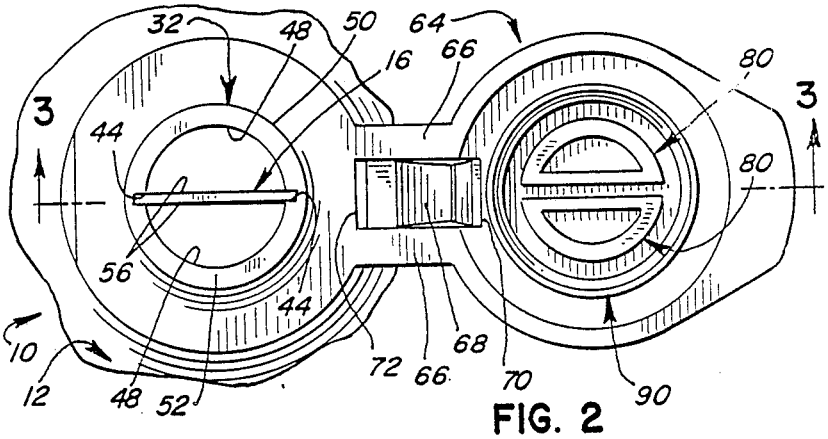
FIG. 2 is a greatly enlarged, fragmentary, top plan view of the package illustrated in FIG. 1.
Figure 3:
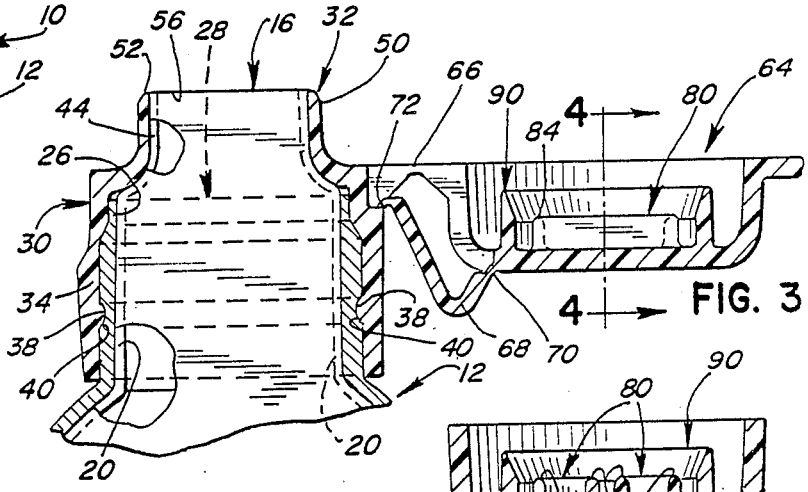
FIG. 3 is a fragmentary, cross-sectional view taken generally along the plane 3—3 in FIG. 2.

With reference to FIG. 3, the container 12 has a generally cylindrical neck 26 defining an open end 28. The container 12 is adapted to be closed by a cover 64. In the preferred embodiment illustrated in FIGS. 1–6, the cover 64 is attached to a cover base 30 which in turn is mounted on the container neck 26 and which defines a peripheral outlet wall 32.

The cover base 30 includes a generally cylindrical skirt 34 which may be either releasably or permanently retained on the exterior of the container tube neck 26. To this end, the exterior surface of the neck 26 may be provided with an annular concave groove 38, and the inner surface of the skirt 34 may be provided with an inwardly projecting, annular protuberance, bead, or ring 40 for being engaged in the groove 38. This provides a conventional groove and bead snap-fit engagement. The cover base 30 could also be permanently attached with adhesive, ultrasonic or radiofrequency welding, or the like, by bonding the skirt 34 to the neck 26.

The cover base 34 can be mounted on the container neck 26 by pushing the cover base 30 downwardly so that the skirt 34 slides over the container neck 26 until the skirt bead 40 snaps into the container neck groove 38.

In the embodiment illustrated in FIG. 3, a reduced-width portion of the divider wall 16 extends upwardly beyond the top of the container neck 26. The cover base peripheral outlet wall 32 has a reduced diameter annular configuration extending upwardly from the skirt 34 and has a diameter that is somewhat less than the width of the projecting portion of the divider wall 16. The cover base outlet wall 32 defines vertical grooves 44 (FIGS. 2 and 3) for receiving the peripheral margins of the divider wall 16. Within the cover base outlet wall 32, the divider wall 16 has oppositely facing sealing surfaces 56 as best illustrated in FIGS. 2 and 6.

Figure 6:
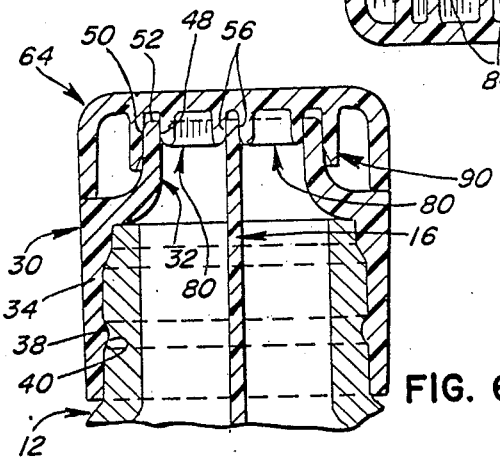
FIG. 6 is a cross-sectional view taken generally along the plane 6—6 in FIG. 5.

The cover base outlet wall 32 has interior peripheral sealing surfaces 48 (FIGS. 2 and 6) and has an exterior peripheral sealing surface 50 (FIGS. 2 and 6). The outlet wall 32 terminates in a distal end surface 52 above the sealing surfaces 48 and 50 (FIG. 6).

It will be appreciated, with reference to FIG. 2, that the peripheral outlet wall 32 and the divider wall 16 cooperate to define a plurality of discharge passages each communicating with a respective one of the storage compartments in the container 12. A portion of the inner periphery of each discharge passage is defined by the sealing surface 56 at the upper end of the divider wall 16. Also, the interior peripheral sealing surface 48 of the outlet wall 32 defines a portion of the inner periphery of the discharge passage.

Although the cover base 30 is illustrated as a separate component in the preferred embodiments illustrated in the figures, it is to be realized that the container 12 may include a unitary cover base at its upper end with a configuration similar to that shown for the separate cover base 34. That is, a unitary upper end of the container 12 would be configured to directly receive the cover 64. Alternatively, other suitable configurations may be provided at the upper end of the container 12, with or without a separate closure base component.

In the preferred embodiment illustrated in FIG. 1–6, the cover 64 is connected to the cover base 30 via a snap-action hinge that may be of a conventional molded plastic design which includes two spaced-apart main bend film hinges 66 (FIGS. 2 and 3) and an offset connecting spring link 68. One end of the link 68 is connected to the cover 64 via a film hinge 70 and the other end is connected to the cover base skirt 34 via a film hinge 72.

The above-described snap-action hinge structure permits the cover 64 to be moved between the open and closed positions because the link 68 deforms elastically through a dead center position at which the link 68 is maximally deformed. On either side of the dead center position, the deformation of the link 68 is at least partly reduced, and the cover 64 is thus urged to a stable position at the end of its travel range on that side of the dead center position. In this manner, when the cover 64 is closed (FIG. 5), it is self-maintained in the closed position. On the other hand, when the cover 64 is open (FIG. 3), it is self-maintained in that position to accommodate dispensng of the contents without having to use one's fingers to hold the cover out of the way.

Although the preferred embodiment is illustrated in FIGS. 1–6 with the cover 64 attached to the cover base 30, it will be appreciated that the cover 64 may be connected directly to the top of the container 12. In that case, the top of the container 12 would have an appropriate configuration which may be similar to the configuration of the illustrated cover base 30.

Further, in another form of the invention, the cover 64 need not be connected to the cover base 30 or to the container 12, and would be completely removable from the container 12. However, in the preferred form of the invention, the cover 64 is connected, preferably with the illustrated snap-hinge, to the container 12 (or to the cover base 34 mounted on the container 12 as illustrated) so as to provide a convenient, complete package 10 in which the cover 64 is always associated with the package 10, even when the package 10 is open.

Figure 5:
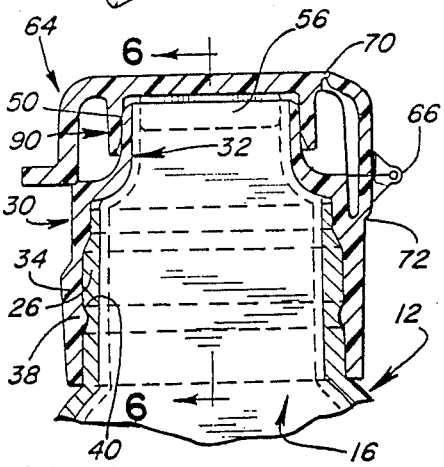
FIG. 5 is a view similar to FIG. 3, but showing the cover in the closed position.

The cover 64 includes a plurality of downwardly projecting interior seal members 80 (FIG. 2) which are adapted to project into a respective one of the container discharge passages when the cover 64 is closed (as illustrated in FIGS. 5 and 6) so as to seal against the divider wall 16 and against the interior peripheral sealing surfaces 48 that define the inner periphery of the discharge passages.

As can be seen in the plan view in FIG. 2, each cover seal member 80 is a generally hollow member having an open end with an axial cross-sectional shape in the form of a sector of a circle which is generally congruent to the sector defined by the discharge passage of the container outlet.

Figure 4:
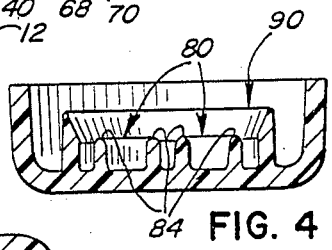
FIG. 4 is a cross-sectional view taken generally along the plane 4–4 in FIG. 3.

The two seal members 80 are spaced apart by an amount sufficient to receive the upper peripheral edge of the divider wall 16 in sealing engagement as best illustrated in FIG. 6. The exterior, semi-circular arc surface of each seal member 80 seals against the interior peripheral sealing surface 48 of the associated discharge passage of the container 12. To facilitate insertion of each seal member 80 into the associated discharge passage, each seal member 80 is defined by flexible, projecting seal walls which have curved distal ends 84 as best illustrated in FIGS. 3 and 4.

In the preferred form of the invention illustrated in FIGS. 1–6, the cover 64 further includes a projecting peripheral seal member 90. The seal member 90 has the configuration of an axially projecting annular wall which is adapted to cicumferentially engage the exterior peripheral sealing surface 50 of the cover base peripheral wall 32 when the cover 64 is closed as best illustrated in FIGS. 5 and 6.

The container 12 of the package 10 may be continuously extruded in a tube configuration and then end-sealed or may be individually molded. The outlet end of the tube may be a post-formed extrusion or may be molded. The container can be provided with a molded dispensing closure which includes the cover base and cover or lid.

The package 10 of the present invention permits separated substances to be simultaneously dispensed from a single container to give a generally precise, pre-established flow-mix ratio. Thus, the dispensing of the substances can be relatively easily and precisely controlled. This is especially useful for substances which must be separated until they are to be mixed and which are difficult to otherwise dispense and mix correctly.

Figure 7:
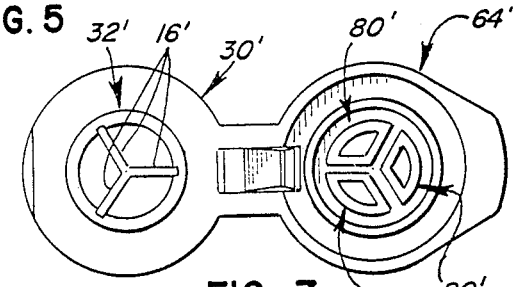
FIG. 7 is a top plan view of an open closure which may be mounted on a receptacle as a second embodiment of the present invention.

An alternate embodiment of the present invention is illustrated in FIG. 7 wherein a cover base 3040 is provided with a hingedly attached cover 64'. The base 30' may be mounted to a suitable container (not illustrated). Alternatively, the cover base 30' may be formed as an integral part of the upper end of the container.

In any case, the cover base 30' has a peripheral outlet wall 32'. A divider means is provided in the form of a plurality of divider walls 16' which extend to the outlet wall 32' radially from a central point to define the axial cross-sectional shape of each discharge passage as the sector of a circle. In the embodiment illustrated in FIG. 7, three such divider walls 16' are arranged uniformly to define three 120 degree angles.

The cover 64' includes three hollow seal members 80'. Each hollow member 80' has an open end and has an axial cross-sectional shape in the form of a sector generally congruent to the sector of a respective one of the discharge passages defined by a pair of the divider walls 16' and peripheral arc of the outlet wall 32'.

Figure 8:
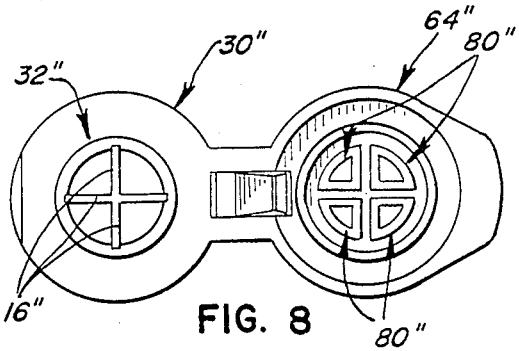
FIG. 8 is a top plan view of an open closure which may be mounted on a receptacle as a third embodiment of the present invention.

A third embodiment of the present invention is illustrated in FIG. 8 and is substantially similar to the second embodiment illustrated in FIG. 7 except that a cover base 30'' has an outlet wall 32'' which cooperates with four divider walls 16'' arranged uniformly to define four 90 degree angles. A cover 64'' is provided with mating hollow seal members 80'' which each have a configuration of a sector of a circle. The sector shape of each seal member 80'' is generally congruent to the sector of an associated discharge passage defined by a pair of the divider walls 16'' and the circular arc of the outlet wall 32''.

In the embodiments illustrated in FIGS. 7 and 8, the divider walls 16' or 16'' may be characterized as extending radially from a central point to the peripheral outlet wall 32' or 32''. The first embodiment illustrated in FIGS. 1–6 may be analogously characterized. Specifically, with reference to the plan view of FIG. 2, the single divider wall 16 may be characterized as "two" divider walls each extending from a central point in opposite directions in a common vertical plane.

The divider walls in all of the embodiments, divider walls 16, 16' and 16'', may be integrally molded with the container or cover base or may be fabricated as separate components for being received between appropriately configured wall portions of the container. To this end, the particular arrangement of the grooves 44 in the outlet wall 32 and of the recesses 20 in the container wall sections for accommodating the divider wall 16 in the first embodiment illustrated in FIGS. 1–6 may be adapted for the three divider walls 16' or four divider walls 16'' of the second and third embodiments illustrated in FIGS. 7 and 8, respectively.

Of course, it will be understood that the use of the alternate embodiment structures illustrated in FIGS. 7 and 8 contemplate use with a container having a plurality of separate storage compartments corresponding to the multiple discharge passages between the divider walls (16' or 16''). To this end, the container for use with the embodiment illustrated in FIG. 7 would have three divider walls and three storage compartments while the container for use the embodiment illustrated in FIG. 8 would have four divider walls and four storage compartments.

With any of the embodiments of the present invention, it will be recognized that the cover sealing members (e.g., sealing members 80 in the first embodiment illustrated in FIGS. 1–6), seal inwardly of the distal end of the opening and seal for some distance along the longitudinal (vertical) surfaces inwardly of the opening. This ensures that the substances within the container are properly sealed from the ambient atmosphere. This also ensures that the substances are kept separated within the container and cannot come into contact with each other in the outlet area of the container adjacent the cover 64. This is especially important when the container is used for substances which might be different reactive components that, when combined, chemically react.

It will also be appreciated that the present invention permits the container to be provided with a plurality of separate compartments and to be provided with an outlet end that readily accepts a fitment or cover base which easily aligns with, and which is readily retained on, the container.

Further, when the cover is provided with a unitary attachment to the container or to the cover base mounted on the container, the cover is easily aligned for closure of the container. This ensures proper alignment of the cover sealing members (e.g., sealing members 80 and 90 in FIGS. 1, 5, and 6) with the associated discharge passages and peripheral outlet wall.

Further, the novel features of the present invention accommodate the use of a separate fitment or cover with base which may be mounted to the container with a snap-on engagement. Alternatively, a threaded engagement could also be accommodated.

Finally, the novel package of the present invention permits the container to be fabricated as a tube with a crimped or sealed, flat end. It also accommodates the use of a container having a flat bottom, such as a circular, flat bottom in a cylindrical container or a square or rectangular flat bottom in a container with generally flat sides.

It will be readily observed from the foregoing detailed description and from the illustrated embodiments thereof that numerous variations and modifications may be effected without departing from the true spirit and scope of the novel concepts or principles of this invention.

What is claimed is:

1. A package for dispensing at least two substances simultaneously in an adjacent relationship, said package comprising:

a container;

divider means for internally dividing the interior volume of said container into a plurality of separated storage compartments;

said container having an outlet end with a peripheral annular outlet wall defining wall defining a discharge aperture communicating with said compartments, said outlet wall having a cylindrical exterior peripheral sealing surface, and said outlet wall having interior peripheral sealing surfaces;

said divide means including at least one divider wall projecting within said discharge aperture, each said divider wall extending to said peripheral annular outlet wall to define, in cooperation with said outlet wall interior peripheral sealing surfaces, a plurality of discharge passages each communicating with a respective one of said compartments, each said divider wall having generally oppositely facing sealing surfaces that each define a portion of the inner periphery of a respective one of said discharge passages, the cooperative arrangement of each said divider wall and said outlet wall providing each said discharge passage with (1) one of said interior peripheral sealing surfaces in the form of a partially cylindrical surface and (2) at least one planar sealing surface defined by said divide wall whereby said discharge passage has a transverse cross-sectional flow area in the form of a sector of a circle; and a cover for securement to said container over said outlet end, said cover including (1) a downwardly projecting peripheral seal member having an interior cylindrical sealing surface for sealing against said exterior peripheral sealing surface of said container outlet wall, and (2) a plurality of downwardly projecting interior seal members, each said interior seal member including a planar seal wall and a partially cylindrical seal wall which together have a perimeter with a transverse cross-sectional shape in the form of a sector of a circle generally congruent to the flow area of the sector of one of said discharge passages, said interior seal members being arranged with the partially cylindrical seal walls located on the locus of a circle and with each said planar wall of one of said seal members being parallel to, but spaced from, a planar wall of another of said seal members whereby, when said cover is secured to said container over said outlet end, said seal members project into a respective one of said discharge passages to seal against the sealing surfaces of the outlet wall and each divider wall that define the inner periphery of said respective one discharge passage.

2. The package in accordance with claim 1 in which said outlet wall terminates in a distal end surface above said exterior and interior peripheral sealing surfaces; and said package includes a plurality of said divider walls and each said divider wall terminates in a distal end surface above said oppositely facing sealing surfaces.

3. The package in accordance with claim 2 in which said distal end surfaces of said divider walls and outlet wall lie in a common plane.

4. The package in accordance with claim 1 in which said container includes an open ended tube;

said container outlet end includes a cover base mounted on said tube to define said container peripheral annular outlet wall; and said package further includes a hinge means for hingedly connecting said cover to said cover base for movement between (1) a closed position in which said cover seal members are in sealing engagement with said container outlet end sealing surfaces, and (2) an open position sealingly disengaged from said container outlet end sealing surfaces to permit dispensing of said substances from said discharge apertures.

5. The package in accordance with claim 4 in which said tube includes a generally cylindrical neck defining an open end; and said cover base includes (1) a generally cylindrical skirt for being releasably retained on the exterior of said tube neck, and (2) a reduced diameter annular wall extending upwardly from said skirt to define said container peripheral annular outlet wall, said annular wall defining interior axially oriented grooves for receiving margins of said divider walls.

6. The package in accordance with claim 1 in which said outlet end of said container is defined by a reduced diameter portion at the top of said container; and said container includes a collapsible dispensing portion extending from said reduced diameter portion.

7. The package in accordance with claim 1 in which each said cover seal member is a hollow member having an open end.

8. The package in accordance with claim 1 in which said divider means includes three of said divider walls arranged uniformly to define three 120 degree angles.

9. The package in accordance with claim 1 in which said divider means includes four of said divider walls arranged uniformly to define four 90 degree angles.

10. The package in accordance with claim 1 in which said divider means includes two of said divider walls each extending from said central point in opposite directions in a common vertical plane to define a single, unitary, planar wall structure.

11. The package in accordance with claim 1 in which each said seal member is defined by projecting seal walls which have curved distal ends for facilitating insertion of each said seal member into a respective one of said discharge passages.

12. A package for dispensing at least two substances simultaneously in an adjacent relationship, said package comprising:

a container having a plurality of separated storage compartments, said container including a tube having a generally cylindrical neck defining an open outlet end and a cover base mounted on said tube neck, said cover base including (1) a generally cylindrical skirt for being retained on the exterior of said tube neck, and (2) a peripheral outlet wall extending upwardly from said skirt;

said container having at least one interior divider wall extending at least from said compartments into said cover base and cooperating to define a plurality of discharge passages which each communicate with a respective one of said compartments, said cover base outlet wall defining interior axially oriented groves for each receiving a margin of one of said divide walls in sealing engagement, said cover base outlet wall further having interior peripheral sealing surfaces that are located between aid grooves and that each define a portion of the inner periphery of a respective one of said discharge passages, each said divider wall having generally oppositely facing sealing surfaces that each define a portion of the inner periphery of a respective one of said discharge passages; and a cover for being releasably secured to said cover base at said tube outlet end, said cover including at least a plurality of downwardly projecting interior seal members or each projecting into a respective one of said discharge passages to seal against the sealing surfaces of the divider wall and cover base outlet wall that define the inner periphery of said respective one discharge passage.

13. The package in accordance with claim 12 in which each said divider wall extends to said peripheral outlet wall to define the axial cross-sectional shape of each said discharge passage as a sector of a circle; and each said cover seal member is a hollow member having an open end and having an axial cross-sectional shape in the form of a sector generally congruent to the sector defined by a respective one of said discharge passages.

14. The package in accordance with claim 13 in which said package includes three of said divider walls arranged uniformly to define three 120 degree angles.

15. The package in accordance with claim 13 in which said package includes four of said divider walls arranged uniformly to define four 90 degree angles.

16. The package in accordance with claim 13 in which said package includes two of said divider walls each extending from said central point in opposite directions in a common vertical plane to define a single, unitary, planar wall structure.

17. The package in accordance with claim 13 in which each said hollow seal member is defined by flexible projecting seal walls which have curved distal ends for facilitating insertion of each said seal member into a respective one of said discharge passages.

18. The package in accordance with claim 12 in which said tube and cover base include means for releasably retaining said cover base on said tube;

said cover base outlet wall has an exterior peripheral sealing surface; and said cover further includes downwardly projecting peripheral seal member for sealing against said exterior peripheral sealing surface of said cover base outlet wall.

19. The package in accordance with claim 12 in which said package includes a plurality of said divider walls;

said divider walls extend throughout the length of said container interior to define said plurality of separated compartments;

said cover base outlet wall is annular and terminates in a distal end surface above said interior peripheral sealing surfaces; and said oppositely facing sealing surface of each said divider wall are generally planar and each said divider wall terminates in a distal end surface above said oppositely facing sealing surfaces.

20. The package in accordance with claim 12 in which said container includes a tube having a generally cylindrical neck defining an open end; and said container outlet end includes a cover base mounted on said tube neck to define said peripheral outlet wall, said cover base including (1) a generally cylindrical skirt for being releasably retained on the exterior of said tube neck, and (2) a reduced diameter annular wall extending upwardly from said skirt to define said container peripheral outlet wall, said annular wall defining interior axially oriented grooves for receiving margins of said divider walls.

* * * * *

UNITED STATES PATENT AND TRADEMARK OFFICE

CERTIFICATE OF CORRECTION

PATENT NO. : 4,964,539

DATED : October 23, 1990

INVENTOR(S) : Bruce M. Mueller

It is certified that error appears in the above-identified patent and that said Letters Patent is hereby corrected as shown below:

Column 5, line 38, "3040" should be --30'--;

Column 7, line 19, "wall defining wall defining" should be --wall defining--;

Column 7, line 24, "divide" should be --divider--;

Column 7, line 40, "divide" should be --divider--;

Column 9, line 10, "divide" should be --divider--;

Column 9, line 12, "aid" should be --said--;

Column 10, line 14, "includes" should be --includes a--.

Signed and Sealed this

Seventh Day of April, 1992

*Attest:*

HARRY F. MANBECK, JR.

*Attesting Officer*

*Commissioner of Patents and Trademarks*